US006585235B2

(12) United States Patent
Pattullo

(10) Patent No.: US 6,585,235 B2
(45) Date of Patent: Jul. 1, 2003

(54) FUEL REGULATING MECHANISM AND METHOD FOR A ROTARY THROTTLE VALVE TYPE CARBURETOR

(75) Inventor: George M. Pattullo, Caro, MI (US)

(73) Assignee: Walbro Corporation, Cass City, MI (US)

( * ) Notice: Subject to any disclaimer, the term of this patent is extended or adjusted under 35 U.S.C. 154(b) by 0 days.

(21) Appl. No.: 09/975,669

(22) Filed: Oct. 11, 2001

(65) Prior Publication Data

US 2003/0071370 A1 Apr. 17, 2003

(51) Int. Cl.[7] ..... F02M 9/02; F02M 9/08
(52) U.S. Cl. ..... 261/44.8; 261/45; 261/47
(58) Field of Search ..... 261/44.6, 44.7, 261/44.8, 44.9, 35, 45–48, 54–57, 63, 44.2

(56) References Cited

U.S. PATENT DOCUMENTS

| | | | | |
|---|---|---|---|---|
| 1,737,496 A | * | 11/1929 | Feroldi | 261/44.8 |
| 4,058,093 A | * | 11/1977 | Kohno et al. | 261/23.2 |
| 4,271,096 A | * | 6/1981 | Kobayashi | 261/44.8 |
| 4,481,152 A | | 11/1984 | Kobayashi et al. | 261/35 |
| 4,481,153 A | * | 11/1984 | Kobayashi et al. | 261/44.2 |
| 5,709,822 A | | 1/1998 | Togashi | 261/44.2 |
| 5,711,901 A | | 1/1998 | Berg et al. | 261/35 |
| 6,394,424 B2 | * | 5/2002 | Pattullo et al. | 261/35 |

FOREIGN PATENT DOCUMENTS

| | | |
|---|---|---|
| DE | 3247603 A1 | 7/1973 |
| JP | 58-110847 | 7/1983 |

* cited by examiner

*Primary Examiner*—Richard L. Chiesa
(74) *Attorney, Agent, or Firm*—Reising, Ethington, Barnes, Kisselle, P.C.

(57) ABSTRACT

Method of and mechanism for regulating fuel feed from a rotary valve type carburetor to an associated engine. A carburetor bypass air passage variably communicates the throttle valve hole with a bypass air source at engine idle setting of the throttle valve. The bypass air passage outlet is closed by movement of the throttle valve out of idle setting toward high speed. At an initial carburetor-to-engine set-up and calibration, a bypass regulating valve is maintained open while the engine is running at idle speed. Then the fuel-regulating needle is adjusted to maximum fuel to air (F/A) mixture ratio permitted by applicable engine exhaust quality regulations, and then is permanently set and sealed. During subsequent end user operation of the engine, the bypass valve is closed only when preparing to crank the engine for starting to thereby provide an enriched fuel-to-air mixture for starting of the engine. When the engine is running under its own power the bypass valve is maintained open. The bypass branch passage outlet is constructed and arranged relative to travel of the upstream control edge of the throttle valve hole so as to modulate by design the fuel flow versus engine speed during part throttle acceleration due to corresponding travel of the control edge past this bypass outlet.

43 Claims, 7 Drawing Sheets

A: Enriched Starting with Air Bleed closed
B: Air Bleed opened as engine starts and approaches normal idle speed
C: Part throttle is enriched as Air Bleed hole becomes covered by throttle valve
D: Typical part throttle without benefit of enrichment
E: Non-enriched starting with air bleed open

FUEL REGULATING MECHANISM AND METHOD FOR A ROTARY THROTTLE VALVE TYPE CARBURETOR

FIELD OF THE INVENTION

This invention relates to a rotary throttle type carburetor suitable for use with a small internal combustion engine, for powering portable implements such as hand held chain saws, weed trimmers, brush cutters and the like, more particularly to a fuel regulating mechanism for such a rotary throttle type carburetor.

BACKGROUND OF THE INVENTION

Rotary throttle type carburetors are currently used to provide the combustion fuel requirements for a wide range of two-stroke-cycle and four-stroke-cycle engines, including hand held engines, such as engines for chain saws and weed trimmers. Typically these carburetors are diaphragm type utilizing a fuel-metering diaphragm operative to control the delivery of fuel from the carburetor regardless of its orientation. There is an increasing trend to provide a so-called "mini-four-stroke" type small engine in order to achieve better fuel economy and reduced exhaust gas air pollutants as compared to a comparable two-stroke cycle engine. However, the very minute quantity of fuel required to power a mini-four-stroke at idle speed in turn requires that the idle mixture needle be set to establish a very tiny overall idle outlet opening in the fuel jet port of the fuel supply pipe. This in turn can lead to problems of sensitivity to needle tip axial movement as well as clogging from debris in the fuel.

As is well understood in the art, a rotary throttle type carburetor typically comprises a cylindrical throttle valve having a throttle hole disposed in the air intake passage of the carburetor body, and the quantity of combustion air intake to the engine is controlled by rotation of the throttle valve. The quantity of fuel delivered to the engine is controlled by the relative position of a needle attached to the throttle valve that is raised and lowered by a cam that rotates with the throttle valve so that the tip of the mixture needle moves along a fuel jet side port of a fuel supply pipe to vary the open area of the fuel jet port.

There are various known methods for regulating the low speed or idle speed fuel delivery of such rotary valve carburetors. One such method and mechanism is disclosed in Japanese Patent Application Publication No. 110847/1983 and in corresponding German Patent DE 3247603 A1 (1983), FIG. 2 of which is also shown as prior art in FIG. 5 of U.S. Pat. No. 5,709,822 and described therein at column 1, lines 47–60, as follows:

> A valve type carburetor disclosed in Japanese Patent Laid-Open No. 110847/1983 is known in which, as shown in FIG. 5, in order to change a flow of air with respect to a fuel pipe 16 which projects toward a throttle hole 17*b* of a rotary throttle valve 17, that is, in order to change a suction negative pressure exerting on a fuel jet port 16*a* at an idle position of the throttle valve 17, a through-hole 17*c* opening to an inlet of an air intake passage 44 is provided in a wall portion of the throttle 17*b* of the throttle valve 17. In this proposal, the inside diameter of the through-hole 17*c* is selected according to the specification of the engine. Therefore, the fuel quantity at the idle position is fixed to a predetermined value and cannot be freely adjusted.

In the system and mechanism of the aforementioned U.S. Pat. No. 5,709,822, and as best seen in FIG. 3 thereof, an air bleed bypass passage 41 is provided for communicating the main throttle hole or throttle bore 17*b* of the throttle valve 17 with the carburetor intake passage 44 of the carburetor body upstream of the throttle valve. An air quantity regulating needle valve 43 is provided in this bleed passage for adjusting the quantity of bypass air admitted to the rotary throttle valve throttle hole 17*b*.

In order not to exceed the permitted maximum adverse emissions limit of EPA and/or CARB exhaust regulations, the air/fuel (A/F) mixture is set at the factory by permanently adjusting the conventional fuel regulating needle 15 so that at idle throttle setting the size of the fuel jet orifice 16*a* is made small enough to establish the maximum fuel delivery at engine idle speed that is permitted in terms of the applicable exhaust gas regulations. This is done while the air bleed bypass regulating needle valve 43 is screwed in to completely close bypass or block passage 41. Then an anti-tamper closing member (i.e., ball 62) is forced into the mixture needle mounting hole 47*a* and sealed off (as by adhesive 61) so that the fuel regulating needle cannot again be regulated from outside.

However the operator can still regulate (i.e., lean out), if desired, the fuel quantity in the engine idle operating range. The quantity of idle bypass air flowing through the bypass air bleed passage 41 for bypass communicating the throttle hole 17*b* of the throttle valve 17 with air intake passage 44 upstream of the throttle valve is regulated by adjusting the air quantity regulating needle valve 43. If the quantity of air flow through the air passage bypass 41 is thus increased, the A/F mixture becomes leaner, and if this bypass air quantity is decreased, the mixture becomes richer. However, since the maximum concentration of the fuel in the A/F mixture at throttle idle setting has been preset, the idle A/F mixture will not exceed the permitted maximum value of the exhaust gas regulations. That is, even if the air quantity regulating needle valve 43 is fully opened, and even if the air quantity regulating needle valve 43 is removed, the bypass air quantity merely becomes maximum, thus the concentration of the mixture does not become rich because the maximum rate of fuel delivery is independently controlled and has already been preset by the aforementioned factory pre-adjustment of the fuel regulating needle.

Although the adjustment feature of '822 patent air quantity regulating needle valve in the idle bypass passage is a desirable feature in many applications, neither it nor the aforementioned Japanese Laid-Open patent cited therein as prior art to '822 solves the problems of regulating needle sensitivity and clogging of the idle output opening as so established by factory adjustment of the conventional fuel regulating needle.

Moreover, other problems associated with adapting a rotary valve type carburetor to the characteristics of a mini-four-stroke engine are neither recognized nor addressed by these aforementioned prior art documents. For example, there is no way the mechanism can be adjusted to provide a simple enrichment starting system to assist cold start of such an engine (that does not require the addition and use of the current standard choke system for this purpose,) and without affecting wide open throttle (W.O.T.) performance. Also, there is no recognition of nor provision for solving the problem of adjusting the fuel quantity versus engine speed curve produced by the regulated A/F mixture in the range of throttle settings between idle and full throttle to better match the performance requirements for acceleration of the engine in the part throttle range. These problems are particularly acute in small mini-four-stroke engines which are highly sensitive to rich and undesired fuel and air mixture provided to the engine.

OBJECTS OF THE INVENTION

Accordingly, among the objects of the present invention are to provide an improved fuel regulating mechanism for a rotary throttle valve type carburetor, and improved method of operating the same, that overcomes the aforementioned problems, particularly those associated with providing such a carburetor for a mini-four-stroke engine, that provides an improved method of controlling the amount of vacuum or negative pressure exerted on the idle fuel outlet orifice at idle speed setting of the carburetor without significantly reducing the throttle valve opening, that provides a low cost and easy to operate improved starting system for such an engine, as well as other types of engines utilizing rotary throttle valve carburetors, and enables the permanent factory adjustment of the fuel regulating needle to be set "higher" to establish a larger overall idle outlet opening, and hence one that is much less sensitive to needle tip axial movement and the problems of clogging of the idle outlet opening from debris in the fuel flow, that can be factory set in a secure manner to observe exhaust gas emissions regulations and also adjustable by design and/or in operation to improve engine performance in idle, part throttle and high-speed operating modes of the engine, that can be used as a simple enrichment starting system in that, unlike current standard choke systems, does not affect W.O.T. operation, and that utilizes an improved air bleed passage that even if inadvertently left closed will still enable the engine to idle satisfactorily, albeit somewhat rich, and in any event will perform as normal at W.O.T.

Another object of the invention is to provide an improved fuel regulating method and mechanism of the aforementioned character for a rotary throttle (barrel-type) carburetor that enables the air/fuel (A/F) mixture to be factory calibrated to adjust the acceleration ramp or curve of fuel flow versus engine speed so that part throttle operation can be enriched as desired to meet the characteristics of a given engine without requiring the re-installation of a throttle cam plate having a different cam surface or ramp contour selected from an inventory of such cam plates heretofore provided to attempt to satisfy this carburetor-to-engine calibration requirement.

A further object is to provide an improved fuel regulating mechanism and method of the aforementioned character that is capable of achieving the aforementioned objects and yet is of relatively simple design, economical in manufacture and assembly, rugged, reliable, durable and has a long useful life in service.

SUMMARY OF THE INVENTION

In general, and by way of summary description and not by way of limitation, the invention accomplishes one or more of then foregoing objects by providing an improved method of and mechanism for regulating fuel feed from a carburetor to an associated engine. The carburetor is of the aforementioned rotary throttle valve type with a throttle hole disposed in an air intake passage of the carburetor body. Rotational movement of the throttle valve varies the opening area of the throttle hole exposed to the carburetor intake passage for controlling the air flow therethrough. The quantity of fuel released from a fuel jet port of a fuel supply pipe secured to the carburetor body is controlled by the relative position to such jet port of a fuel regulating needle attached to the throttle valve for axial movement therewith. Adjustment of needle regulation of the fuel jet port cannot be made from outside of the carburetor after an idle speed fuel quantity has been set and then the permanent fitment of a closing member.

The carburetor further also has a bypass air passage for variably communicating the throttle valve hole at an upstream portion thereof with a bypass air source, such as ambient atmosphere or the upstream intake air in the carburetor, in bypass relation to the opening area of the throttle hole exposed via a bypass air passage outlet operable at engine idle setting of the throttle valve. The bypass air passage outlet is closed by movement of the throttle valve out of idle setting toward high speed and/or maximum power setting.

Preferably, a bypass air quantity regulating valve is provided in the bypass air passage to variably adjust the quantity of air flowing in the bypass air passage to the throttle hole. At initial carburetor-to-engine set-up and calibration, the bypass air regulating valve is maintained open while the engine is running at idle speed, such as by operating the air valve to a given open setting.

Then the fuel-regulating needle is adjusted to provide the maximum fuel to air (F/A) mixture ratio permitted by applicable engine exhaust air quality regulations. Next, the fuel needle adjustment is permanently set by non-removably fitting the closing member to prevent exterior access to an adjustment portion of the fuel needle.

Preferably thereafter, during subsequent end user operation of the engine, the bypass air regulating valve is closed only when preparing to crank the engine for starting to thereby provide an enriched fuel-to-air mixture for starting of the engine. When the engine is running under its own power the bypass air regulating valve is maintained open.

As an option, the bypass air regulating valve can be adjusted to vary the air flow regulating opening of the same from the given setting to thereby re-adjust the initial set-up idle F/A mixture to a different, leaner or richer, value for end user engine operation. The bypass air regulating valve also may be in the form of a solenoid-operated valve operably coupled to the engine control system such that the valve automatically is closed for engine start up and automatically opened when the engine begins to run under its own power. As a further option, the bypass air regulating solenoid valve has an adjustable end-limit open stop for adjusting its open setting to thereby increase or decrease the air flow regulating opening end limit of the same to re-adjust the initial set up F/A mixture to a different value for engine operation.

In one embodiment, the bypass air passage comprises a tubular conduit extending through a wall of the carburetor to an external connection with a bypass air regulating valve. The bypass air regulating valve may alternatively be (1) a movable flap valve for controllably opening and closing an open upstream inlet of the tubular conduit disposed externally of the carburetor, (2) a solenoid valve having an armature mounted in the tubular conduit with an armature plunger reciprocable therein and having a valve member at its distal end operable for opening and closing a valve port in a valve disk mounted in the tubular conduit, or (3) a normally closed thermal valve that is thermally responsive and operably coupled to the engine to sense and respond to engine operational heat of a given temperature to thereby open the bypass valve.

The bypass passageway, also alternatively, may take the form of a bypass inlet branch passage and a bypass outlet branch passage in the carburetor body, with the inlet opening of the inlet branch passage being located upstream of the throttle valve and the outlet of the outlet branch passage being located for communication with the throttle valve throttle hole in the idle position thereof. For ease of manufacture and calibration, the branch passages are preferably communicated with one another via a chamber in the carburetor exterior surface that is closed by a Welch plug. Preferably, the branch passages are drilled parallel to one another and generally perpendicular to the axis of the carburetor air intake passage.

In this embodiment a solenoid valve may be provided with a needle valve armature having a needle nose at its distal end cooperative with a valve seat formed in one of the branch passages. Preferably this valve seat is at the end of the bypass inlet branch passage entering the Welch plug chamber.

Preferably, and in lieu of changing throttle cam plates from an inventory having different ramp angles, the outlet of the bypass outlet branch passage is located relative to travel of the upstream control edge of the throttle valve throttle hole so as to modulate by design the fuel-to-air mixture ratio curve of fuel flow versus engine speed during part-throttle travel of the control edge past the outlet of the bypass outlet branch passage.

BRIEF DESCRIPTION OF THE DRAWINGS

The foregoing as well as other objects, features and advantages of the present invention will become apparent from the following detailed description of the best mode, appended claims and accompanying drawings wherein:

DETAILED DESCRIPTION OF THE PREFERRED EMBODIMENTS

First Embodiment

Figure 1:
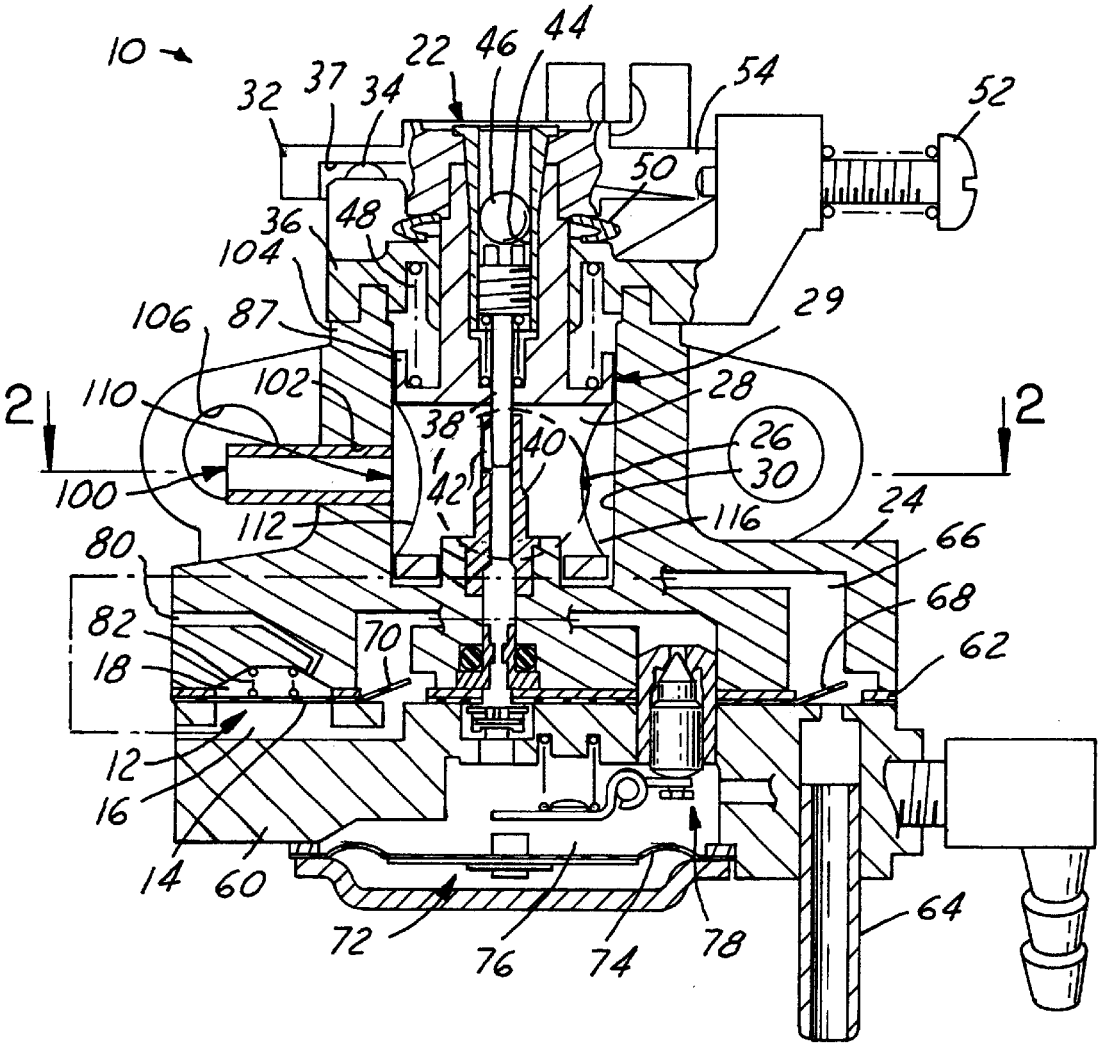
FIG. 1 is diagrammatic sectional view of an improved carburetor embodying a first embodiment of an air bleed bypass system of the present invention and having a rotary throttle valve shown in its idle position.
Figure 2:
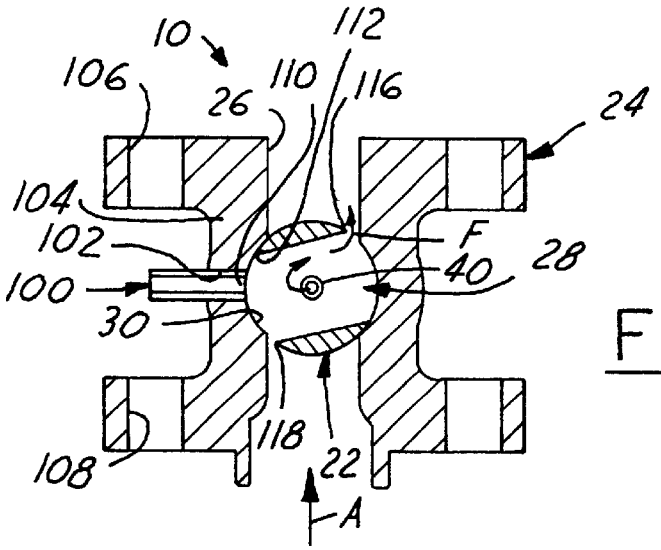
FIG. 2 is a simplified diagrammatic section view of the carburetor of FIG. 1 taken on the section line 2—2 of FIG. 1.

Referring in more detail to the drawings, FIGS. 1 and 2 illustrate a rotary throttle valve type carburetor 10 having a fuel pump 12 with a diaphragm 14 defining in part a fuel chamber 16 on one side and a pressure pulse chamber 18 on its other side.

Figure 3:
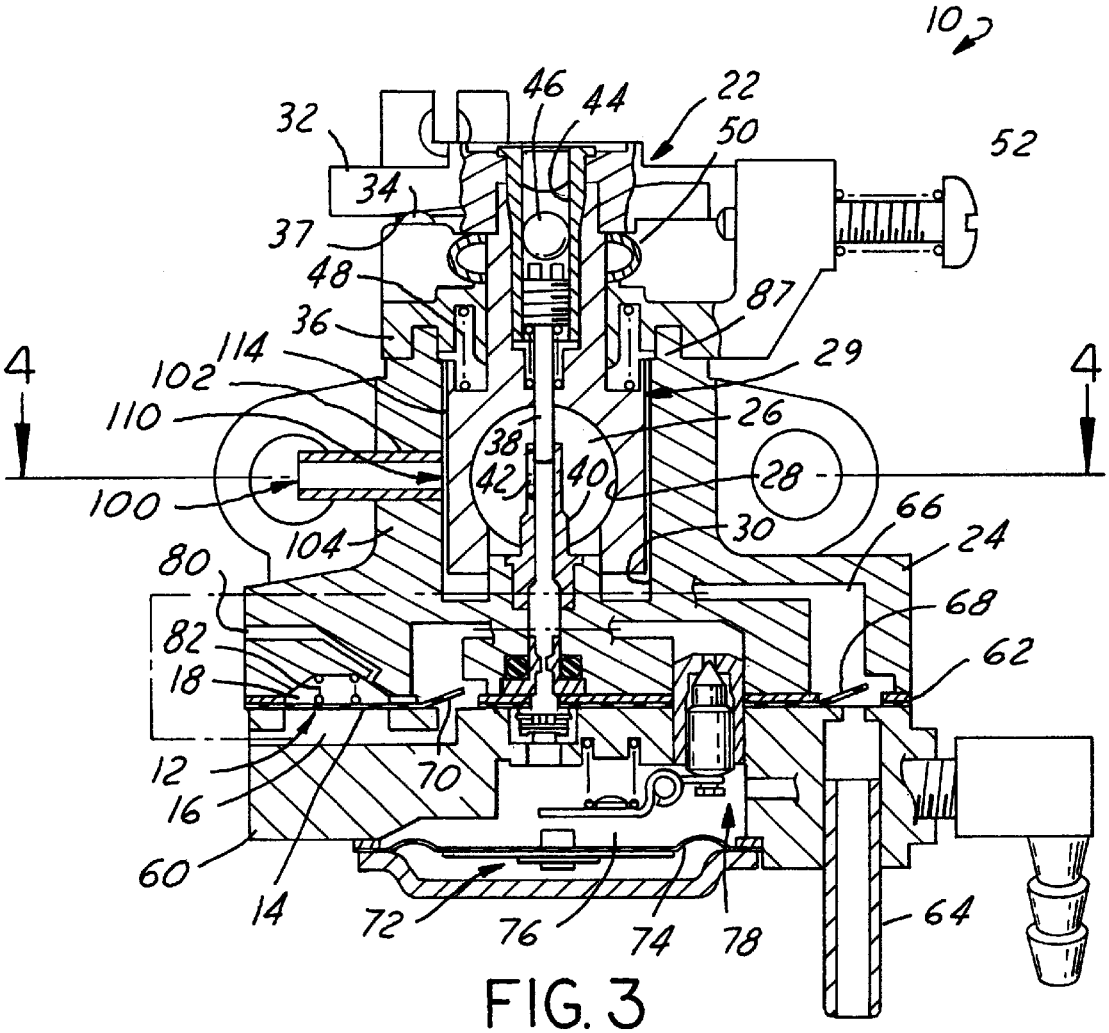
FIG. 3 is a diagrammatic sectional view of the carburetor of FIG. 1 with the rotary throttle valve in its wide open position.

The carburetor 10 has a main body 24 with a fuel and air mixture passage 26 formed therethrough and a rotary throttle valve 22 is disposed in the fuel and air nixing passage 26. The throttle valve 22 has a through-bore 28 selectively and progressively aligned with the fuel and air mixing passage 26 as the throttle valve 22 is controllably rotated and cam-raised to move it between idle (FIGS. 1 and 2) and wide open (FIGS. 3 and 4) positions to thereby control the flow of air and fuel through the carburetor 10. The throttle valve 22 is preferably a generally cylindrical shaft 29 rotatably received in a complementary bore 30 in the body 24 extending generally transversely to the fuel and air mixing passage 26. At one end, the throttle valve 22 has a cam plate 32 extending generally radially outwardly therefrom and engageable with a post, or ball cam follower 34 carried by a throttle valve plate 36 stationarily mounted on the carburetor body 24.

Cam plate 32 has a generally sloped cam surface or ramp 37 to impart axial movement of the throttle valve 22 as the throttle valve is rotated between its idle and wide open positions by operator actuation of the throttle control lever or linkage (not shown). This axial movement of the throttle valve 22 axially moves a fuel mixture needle 38 carried by throttle valve 22 within and relative to tubular a fuel jet 40 carried by the carburetor body 24 to thereby vary the size of a side orifice 42 of the fuel jet 40 to thereby control, at least in part, the amount of fuel discharged from the orifice 42. For calibration purposes, the needle 38 is preferably threaded into a complementary bore 44 in the throttle valve 22 and its position can be altered relative to the throttle valve 22 by rotating it. A spherical ball or plug 46 is preferably press fit into the bore 44 (and/or sealed therein by an adhesive covering, not shown) to permanently prevent access to the needle 38 after it has been initially factory calibrated.

The throttle valve plate 36 traps a coil spring 48 against the throttle valve 22 to provide a force biasing the throttle valve 22 axially downward in its bore 30 (as viewed in FIGS. 1 and 2). An annular flexible seal 50 is disposed around an upper portion of the throttle valve 22 to provide a liquid tight seal between the throttle valve 22 and throttle valve plate 36. An idle adjustment screw 52 is threadably received in the throttle valve plate 36 and is adapted to engage a radially outwardly extending flange 54 fixed to throttle valve 22 to adjustably set a positive angular limit stop position of throttle valve 22 in a desired idle position.

Fuel pump 12 comprises the fuel pump diaphragm 14 trapped between an end plate 60 and the carburetor body 24 with a gasket 62 preferably received between a diaphragm 14 and main carburetor body 24. A fuel inlet fitting 64 is press fit into the end plate 60 and communicated with the fuel chamber 16 through an internal passage 66 of the carburetor body 24 with a flap type inlet valve 68, preferably integral with the fuel pump diaphragm 14, preventing the reverse flow of fuel. Fuel which flows through the inlet valve 68 enters the fuel chamber 16 defined in part by the fuel pump diaphragm 14. Fuel discharged from the fuel chamber 16 flows through an outlet valve 70 which is also preferably a flap type valve integral with a fuel pump diaphragm 14. From there, fuel flows to a conventional fuel metering assembly 72 having a fuel metering diaphragm 74, fuel metering chamber 76 and a diaphragm controlled inlet valve 78 which selectively permits fuel flow into the fuel metering chamber 74. From the fuel metering chamber 74, the fuel flows to the flow jet 40 and into the fuel and air mixing passage 26 in response to a differential pressure across the fuel jet 40, in a known manner. The fuel metering assembly 72 may be as disclosed in U.S. Pat. No. 5,711,901 the disclosure of which is incorporated herein by reference in its entirety.

The pressure pulse chamber 18 is defined on the other side of the fuel pump diaphragm 14 and communicated with the engine intake manifold or engine crankcase through a pressure pulse passage 80. Engine pressure pulses from the intake manifold or engine crankcase are thus communicated with the pressure pulse chamber 18 to vary the pressure therein. Notably, with four-stroke engines, the pressure pulse is predominantly negative or a vacuum pressure which tends to displace the fuel pump diaphragm 14 in a direction tending to increase the volume of the fuel chamber 16 to draw fuel therein. A spring 82 which is preferably a helical coil spring, provides a biasing or return force which tends to displace the fuel pump diaphragm 14 in a direction tending to decrease the volume of the fuel chamber 16 to discharge fuel from the fuel chamber 16 under pressure. In this manner, the displacement of the fuel pump diaphragm 14 draws fuel into the carburetor 10 and discharges fuel under pressure to the fuel metering assembly 72 so that fuel is made available to the engine corresponding to the engine's fuel demand.

As thus far described, carburetor 10 with the rotary throttle valve 22, throttle valve plate 36, fuel jet 40, fuel pump 12 and fuel metering assembly 72 may be of conventional construction to control the flow of fuel and air through the carburetor.

First Embodiment Air Bleed Bypass System

Referring to FIGS. 1–4, a first embodiment of an air bleed bypass system of the present invention, and method of constructing and operating the same in accordance with the invention, comprises the design and installation of an air bleed bypass tube 100 so as to be fixedly mounted in a through-bore 102 provided in a side wall 104 of carburetor 10. It is to be understood that tube 100 is diagrammatically shown as a short straight tube that as shown extends in interfering relation with the coaxial mounting bolt holes 106 and 108 provided in the mounting flanges of carburetor 10. In actual practice, tube 100 would be a bent elbow or have a hose attachment so that it would be clear of and pass around the mounting bolt (not shown) that would extend through holes 106 and 108 in mounting carburetor 10 to an engine.

In accordance one feature of the present invention, the flow-controlling cross sectional area of the outlet opening 110 of tube 100 and its location in valve bore 30 relative to an edge portion 112 defining the upstream opening to throttle passage 28 are predetermined by design to calibrate carburetor 10 to the engine operating requirements in accordance with the method of the invention.

Figure 4:
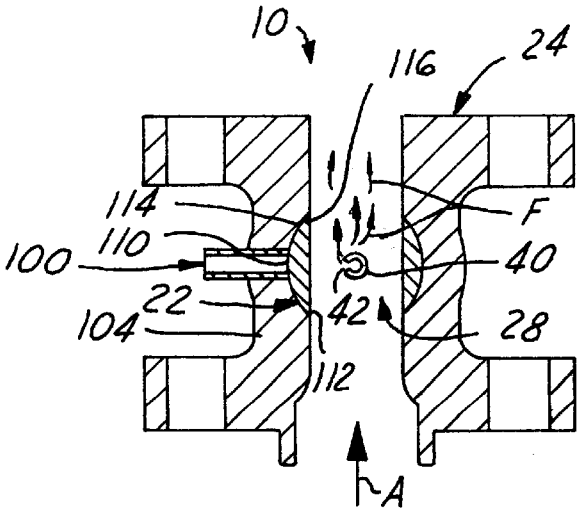
FIG. 4 is a simplified diagrammatic sectional view of the carburetor of FIG. 3 taken on the section line 4—4 of FIG. 3, FIGS. 5 and 6 are fragmentary simplified diagrammatic views of closed and open conditions respectively of a first embodiment external controller for the bypass air bleed inlet of the mechanism and system of FIGS. 1–4.

More particularly, it will be seen by comparing FIG. 2 with FIG. 4 that in the idle condition of carburetor 10 shown in FIG. 2, outlet 110 of bypass tube 100 registers with valve passage 28 in a fully open condition of outlet 110 and tube 100 is generally aimed at the orifice 42 of fuel jet tube 40. It will also be seen by comparing FIGS. 2 and 4 that, as valve 22 is rotated counterclockwise as viewed in these figures from the idle position of FIG. 2 to the wide open throttle (W.O.T.) of FIG. 4, outlet 110 of tube 100 becomes fully blocked by the imperforate outer surface 114 of the portion of the body of valve 22 extending between passage upstream edge 112 and the axially opposite outlet control downstream edge 116 of valve passage 28.

Thus, at idle condition the bypass passage defined by tube 100 is completely open to valve through-passage 28, whereas in the W.O.T. position of valve 22 the bypass passage tube 100 is completely shut off by wall 114 of valve 22. At engine idle throttle setting (FIG. 2) engine manifold intake suction creates a pressure drop across valve passage 28 from the upstream inlet opening defined by the upstream edge 118 of passage 28 and the downstream outlet defined by the edge 116 of passage 28. This creates a given negative pressure condition at jet orifice 42 that is reduced below that which would exist in the absence of tube 100 because tube 100 provides an air bleed bypass to atmosphere of the upstream restriction defined by edge 118. Hence, as thus far described, air bleed tube 100 functions similar to the through-hole 17*c* of the aforementioned prior art Japanese patent application Publication No. 110847/1983 (or corresponding German patent DE 3247603 A1, 1983) that is provided to change the suction negative pressure exerted on the fuel jet port 42 at the idle stop position of throttle valve 22. That is, the inside diameter of tube 100, like the inside diameter of valve through-hole 17*c*, is selected according to the "specification of the engine", i.e., relative to the size of the idle orifice opening set by the axial position of the lower end tip of fuel mixture needle 38 relative to opening 42 (FIG. 1), and relative to the negative suction pressure developed by the engine intake air stream once the engine has started and begun to run at idle. Thus the restricting effect of edge 118 to develop a given negative pressure at jet port 42 is effectively reduced by being bypassed by the air admitted via tube 100 to passage 28.

Accordingly, by changing the diameter of tube 100 or by inserting a restriction orifice plug in the same to provide a controlling orifice in tube 100, the amount of change of the suction negative pressure can be determined as required to achieve and air/fuel mixture ratio for any given setting of the fuel mixture needle 38. Hitherto, as set forth in the aforementioned prior art U.S. Pat. No. 5,709,822, the mixture needle 38 is desirably preset by permanently adjusting the same so that at idle throttle setting the size of the fuel jet orifice is made small enough to establish the maximum fuel delivery at engine idle speed that is permitted in terms of the applicable exhaust gas regulations. Then providing a bypass air bleed passage effective at idle condition will provide a given leaner A/F mixture at idle in an effort to best match the engine idle fuel operational requirements. The degree of this leaness will be determined by the size or the controlling orifice of the bypass passage.

However, it is to be noted that providing the air bleed bypass passage in accordance with the first embodiment system of the invention of FIGS. 1 through 4, i.e., in the form of a tube or equivalent passage through the wall 104 of the carburetor 10, versus the hole 17*c* in the upstream wall of the throttle valve 17 in the Japanese application 110847/1983, is advantageous in several respects, as will become more apparent in the discussion of the second, third and fourth embodiments described hereinafter in more detail.

With respect to the first embodiment, and assuming the A/F idle mixture has been set as desired to be calibrated for a given engine by adjusting the control orifice size of tube 100, the fact that the bypass passage is in the form of a tube extending out of the carburetor body to an external ambient air source in accordance with the invention, allows bypass air to be drawn from any desired location, such as just downstream of the air filter in the engine air intake system, or directly from ambient in accordance with the routing of the inlet to tube 100, as will be readily understood by those skilled in the art. Another advantage is that tube 100 and its bore outlet 102 can be made to a large size and then orifice control plugs inserted into the tube to readily change controlling orifice size in an economical manner that does not require production machining changes required in accordance with the aforementioned Japanese patent application prior art system.

Figure 14:
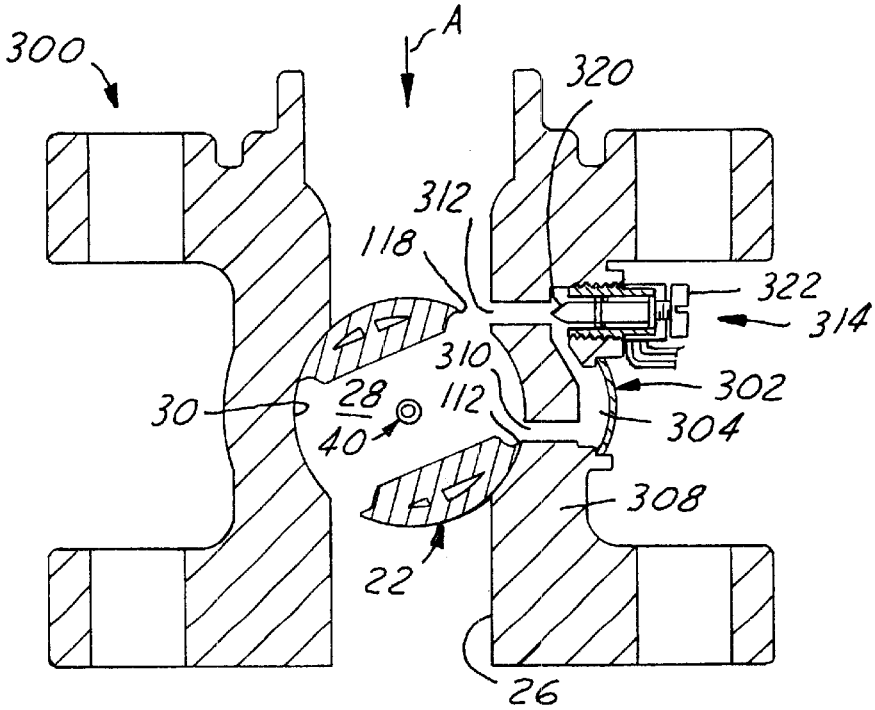

Another significant advantage of the first embodiment air bleed bypass system of FIGS. 14 will become apparent from an understanding of the external controllers that may be alternatively provided for bypass tube 100, as shown in FIGS. 5–8.

First Embodiment External Air Bleed Controller

Figure 5:
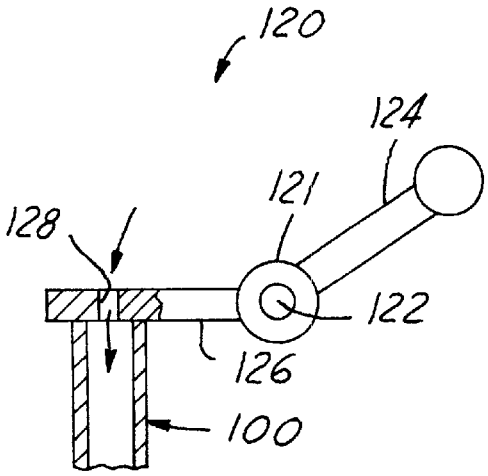
Figure 6:
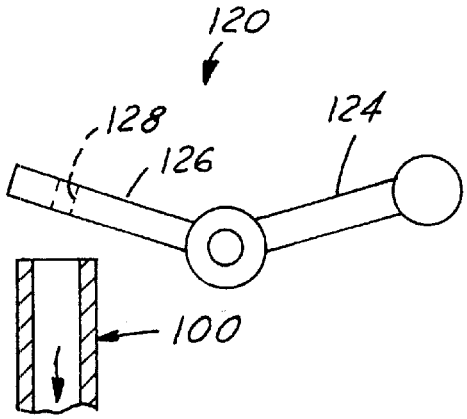

The first embodiment external controller is shown in FIGS. 5 and 6 semi-schematically as a rocker arm type control 120 having a hub 121 suitably mounted for rotation about an axis 122 and so actuated by a control arm 124. A valve opening and closing flap arm 126 is mounted on hub 121 and constructed and arranged so that when arm 124 is rocked to the position of FIG. 5, valve arm 126 sealably overlies the exterior inlet end of tube 100 to thereby block passage of ambient air into the tube except for a small amount of secondary bleed air admitted via a restricted orifice 128 provided in flap arm 126. Orifice 128 is provided for fine adjustment but, if desired, can be omitted so that in the closed position of FIG. 5, flap valve 126 completely blocks air entry into the tube 100.

In the open condition of flap valve 126 shown in FIG. 6, the construction and operation of tube 100 is the same as that described in conjunction with FIGS. 1 through 4. Again, calibration of tube 100 is to be provided according to the requirements of the particular engine for which the carburetor is to be installed and used to provide a given desired A/F mixture at idle. However, in accordance with one feature of the method of the invention, mixture needle 38 is raised in making the factory adjustment to enlarge the controlled orifice provided through opening 42 over that of the conventional setting described in the aforementioned prior art such that even with bleed bypass tube wide open enough fuel is fed at the bypass-reduced suction pressure to establish an A/F mixture at the maximum permissible regulated limit (EPA and/or CARB), assuming that such an engine set up calibration comes closest to meeting the optimum idle fuel/air mixture most desired for best performance of the given engine for which the calibration is being made without violating such regulations.

Then, by using the external controller of FIGS. 5 and 6, when it is desired to start the engine and crank the same for starting, flap valve 126 is set to the closed condition of FIG. 5. Hence only a minute amount of bypass air can be fed to passage 28 of throttle 22, or not at all if orifice 128 is not provided. In either case, due to the air bleed now being effectively eliminated or blocked under this condition, there is a significant increase in negative or suction pressure occurring in throttle passage 28 during cranking of the engine for start ups. Hence an enriched fuel/air mixture is thereby produced to facilitate engine start up without the necessity of providing a choke system for this purpose. Once the engine starts, flap valve 126 is opened so that the desired idle speed A/F mixture is obtained at engine idle speed as calibrated in accordance with the invention for maximum permissible fuel flow with bypass air bleed in operation.

Thus it now will be understood in view of the foregoing that the first embodiment air bleed system of FIGS. 1 through 4 when equipped with the external controller of FIGS. 5 and 6 provides novel apparatus for and method of controlling the amount of signal (vacuum) reaching the idle fuel outlet orifice at jet tube opening 42 as set at idle by needle 38 without significantly reducing the throttle valve opening. Moreover, the ability to control this signal by the external controller 120 also results in a low cost, easy to operate starting system.

In addition, reducing the amount of signal (vacuum) to the idle fuel outlet by introducing bypass air at factory calibration enables the idle mixture needle to be raised significantly in making the permanent factory adjustment of the same described previously. This results in a larger overall idle outlet opening that is much less sensitive to needle tip axial movement, and also less likely to be clogged by debris in the fuel being fed to the jet tube 40.

Figure 9:
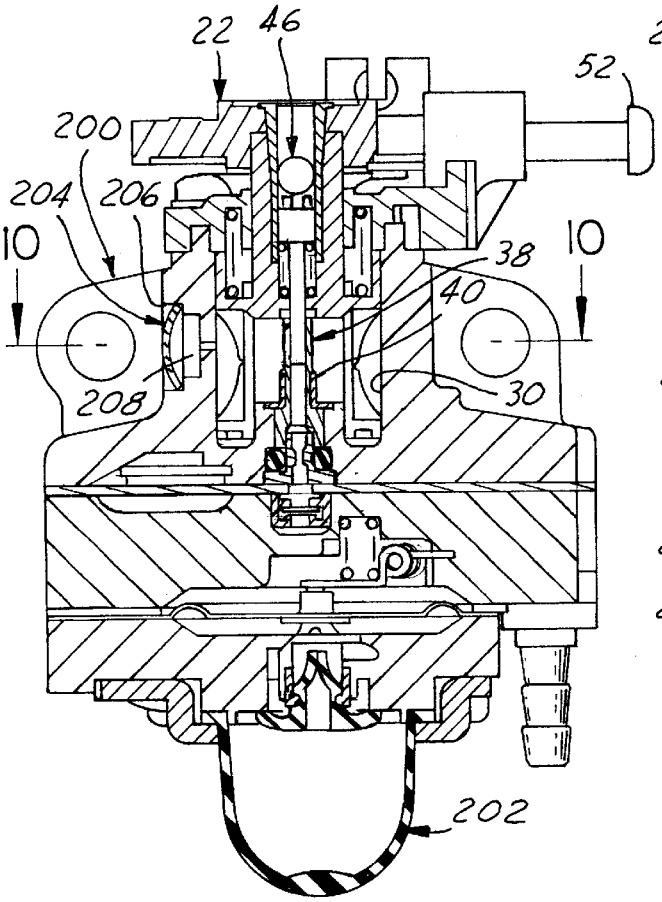
FIG. 9 is a diagrammatic sectional view of an improved carburetor embodying a second embodiment air bleed bypass system of the present invention for a rotary throttle valve, the valve being shown in its idle position.

Air bleed tube 100 thus can be used as part of a simple enrichment starting system that can be activated by simply controllably plugging the air bleed tube 100. Unlike the current standard choke systems of the prior art, such plugging of the air bleed tube 100 does not affect W.O.T. operation. Also, even if the air bleed is inadvertently left closed, as in the FIG. 5 mode, the engine will still idle fine (albeit somewhat rich) and will perform as normal at W.O.T. The external controller for the air bleed tube 100 thus provides a simple, fool proof, low cost starting system that requires only three steps for starting the engine at idle, i.e., (1) purge the unit with the purge bulb 202 provided as shown in FIG. 9, (2) activate the air bleed limiter lever 120 from the open position of FIG. 6 to the closed position of FIG. 5, and (3) then pull the starter until the engine starts. If the limiter is spring biased open, then merely releasing the same when the engine starts will return it to the open condition of FIG. 6 for idle operation at an A/F mixture which does not exceed EPA and/or CARB maximum limits.

Second Embodiment External Air Bleed Controller

Figure 7:
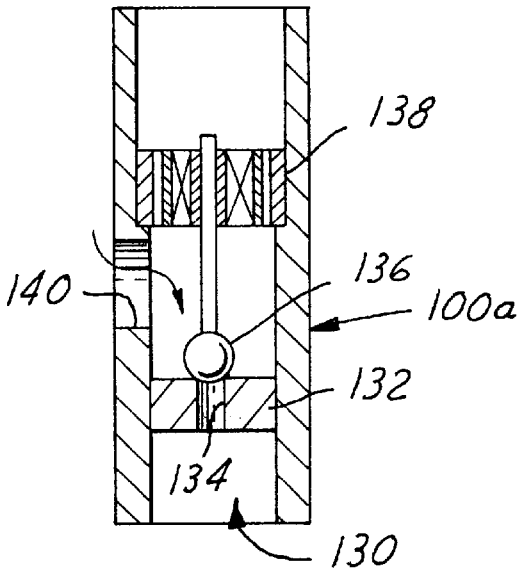
FIG. 7 is a simplified diagrammatic view of a second embodiment external controller for the bypass air bleed inlet of the system of FIGS. 1–4, the same being shown in closed condition.

FIG. 7 illustrates a second embodiment external controller in which a modified air bypass bleed tube 100*a* is installed similar to tube 100 but provided with a solenoid actuated valve 130. This includes a valve seat disk 132 installed in tube 100*a* having a valve passage 134 that is opened and closed by a ball-headed plunger 136. An electromagnetic coil 138 also mounted in bypass tube 100*a* actuates plunger 136 and is responsive to a control signal provided from a conventional ignition system controller (not shown), or from a conventional "cold start" switch (also not shown) activated by and responsive to movement of the throttle valve or throttle valve controlling linkage. Alternatively, solenoid 138 may be responsive to the speed of the engine by operably electrical coupling solenoid 138 to a conventional speed sensing control circuit (not shown). Bypass air can be admitted to the interior of tube 100*a* to flow to valve-control passage 134 via a side port 140 provided in tube 100*a*

Third Embodiment External Air Bleed Controller

Figure 8:
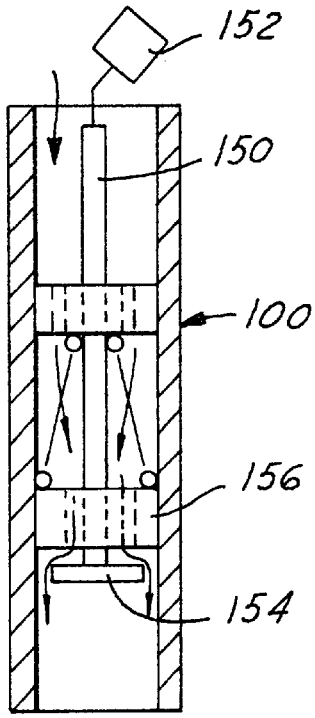
FIG. 8 is a fragmentary simplified diagrammatic view of a third embodiment external controller for the bypass air bleed inlet of the system of FIGS. 1–4 shown in open condition.

Alternatively, as shown in FIG. 8, the external controller may comprise a check valve in the form of a capillary tube 150 communicated with a heat sensing bulb 152 mounted on the engine cylinder block or on the engine exhaust system, such as on the engine muffler (not shown). Heat sensing bulb 152 is operable to displace a valve head 154 relative to a valve seat 156 to control the air flow through the air bypass passage defined by tube 100 as described with reference to the other embodiments.

Of course, still other valves or other fluid control arrangements may be used to control the flow of bypass air through the bypass tube 100 as desired.

Second Embodiment Air Bleed Bypass System

Figure 10:
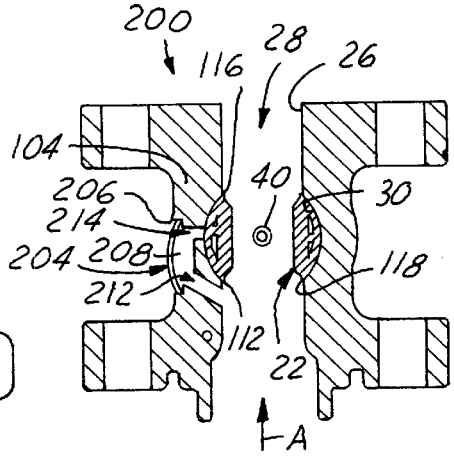
FIGS. 10, 11 and 12 are simplified operational views taken on the line 10—10 of FIG. 9 respectively illustrating the rotary throttle valve in wide open throttle (W.O.T.) condition (FIG. 10), in a part throttle condition (FIG. 11) and in an idle speed condition (FIG. 12)
Figure 11:
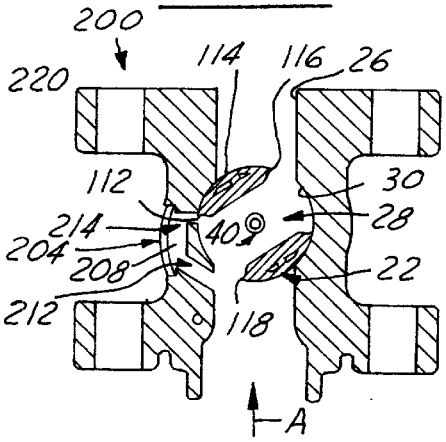
Figure 12:
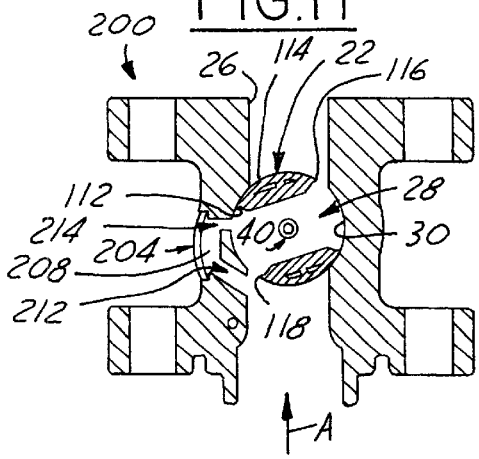

FIGS. 9–12 illustrate a second embodiment air bleed bypass system also provided in accordance with the present invention and shown installed on a rotary throttle valve type carburetor 200. Carburetor 200 is a well known construction and operates similar to carburetor 10 described hereinabove and is provided with the previously mentioned purge system utilizing bulb 202 as is well understood in the art, and is of conventional construction except as modified to incorporate the air bleed system as described hereinafter. FIGS. 10, 11 and 12 illustrate semi-diagrammatically the essential features of the second embodiment air bleed system. This embodiment also includes the rotary throttle valve 22 with its through-passage 28, tubular fuel jet 40 and the throttle valve through-passage control edges 112, 116 and 118 that control main air flow A through the carburetor passage 26 to vary the same in response to throttle valve rotation, as described previously in conjunction with carburetor 10. However, in accordance with a principle feature of the second embodiment air bleed bypass system of the invention, the air bleed passageway system eliminates air bleed tube 100 and instead provides a conventional Welch plug 204 that fits in a Welch plug pocket 206 encircling a Welch plug chamber 208 cast or machined in the side wall 104 of carburetor 200.

As will be seen by comparing FIGS. 10, 11 and 12 with one another, pocket 208 is generally coextensive in its dimension parallel to the axis of passage bore 26 with the axial extent of travel of control edge 112 of the throttle valve passage 28. Chamber 208 also extends further upstream beyond the W.O.T. end limit of travel of edge 112 in order to accommodate the downstream end of a bypass inlet passage 212 that empties into chamber 208. As best seen in FIG. 12, the bypass passageway system further includes a bypass outlet passage 214 whose upstream end communicates with chamber 208 and whose downstream outlet enters carburetor bore 30 at a predetermined point a small distance upstream of the idle position of the throttle valve passage control edge 112.

Thus, in the idle position of throttle valve 22 the upstream opening defined by throttle valve control edge 118 with the wall of bore 30 is bypassed via passage 212, chamber 208 and passage 214 to bleed air into the throttle passage 28 to thereby reduce the suction or negative air pressure in this passage. This in turn thereby reduces the fuel draw from fuel jet 40 to thereby lean down the A/F mixture in the manner of bleed tube 100 in the FIG. 2 condition described previously.

However, in accordance with another feature of the apparatus and method of the present invention, after the engine starts and is being accelerated between idle and wide open throttle speeds in response to rotation of throttle valve 22 counterclockwise as viewed in FIGS. 12, 11 and 10 (in that sequence), passage control edge 112 first encounters and then begins to cover the outlet opening of bypass outlet passage 214 to thereby begin throttling the extent of bypass air being admitted to throttle passage 28. As edge 112 moves across and covers the outlet of passage 214, the cut off of bypass air increases the rate of change of fuel flow as a function of engine speed. An enrichment effect is thereby provided in the early portion of the acceleration curve of fuel flow plotted against engine speed.

Figure 17:
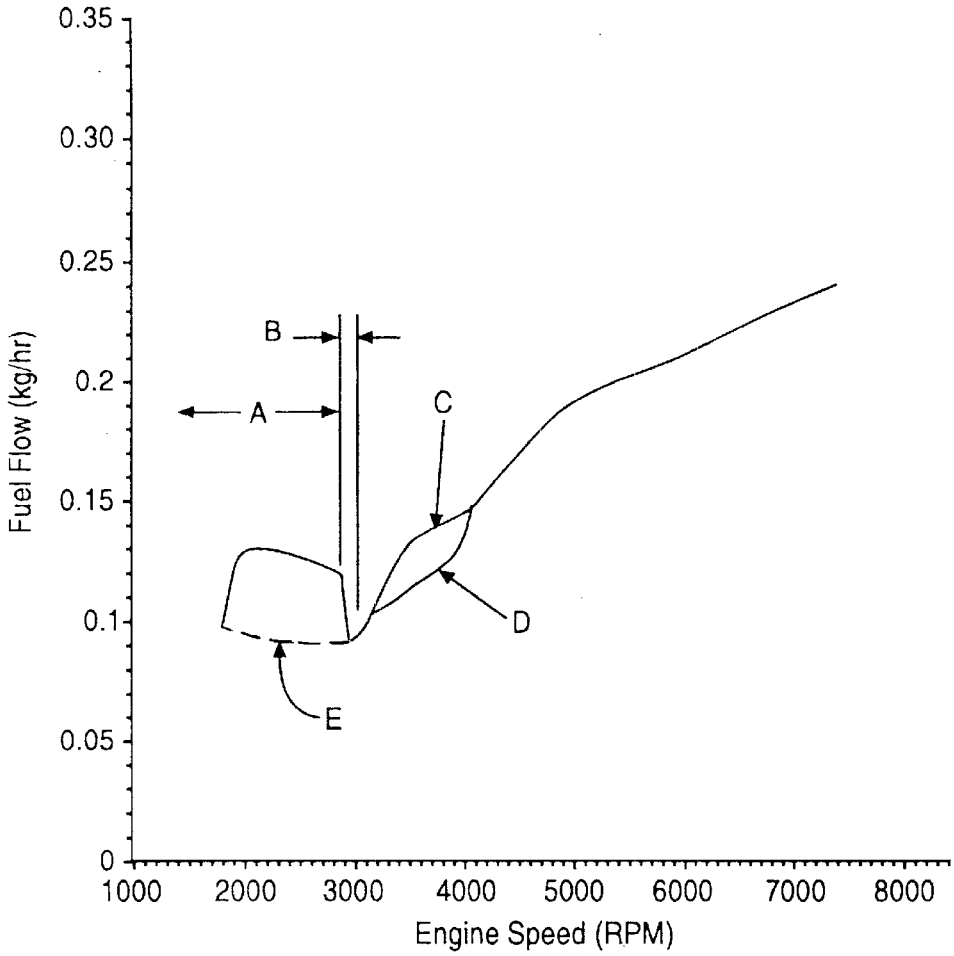
FIG. 17 is a graph of fuel flow plotted against engine speed illustrating the typical operational curves achievable with the first, second, third and fourth air bleed bypass system embodiments of the invention.

Referring to FIG. 17, this acceleration enrichment effect is noted as the portion C of the curve plotted in FIG. 17 and is to be compared to plot portion D, which in turn is a typical part-throttle curve of fuel flow versus engine speed without the benefit of enrichment by closure of the bypass passage early-on in this range of throttle travel. Then once the throttle valve has been further rotated counterclockwise to bring edge 112 just past passage 214, thereby completely blocking the same, the ensuing increase in fuel flow with engine speed follows a relationship as previously without a bypass being provided. In other words, the engine will perform as normal to full or wide open throttle after the air bleed is closed.

It will be noted that in the second embodiment system the timing of closure of the bypass outlet passageway 214 as a function of degrees of throttle rotation between idle position (FIG. 12) and full closure of bypass outlet passage 214 by the throttle surface (FIG. 10), can be readily varied by design and manufacture to calibrate carburetor 200 to a given engine. Thus, with Welch plug 204 removed it is an easy task for manufacturing to shift the drill location for drilling bypass outlet passage 214 either upstream or downstream in the direction of the axis of passage 26 while keeping the drill orientation perpendicular to this axis for ease of manufacture. Hence, the casting for making the body of the carburetor can be standardized in manufacture while retaining the ability to economically calibrate the carburetor by changing the location of bypass outlet passage 214 in this manner.

The air bleed bypass inlet passageway 212 may have a fixed location regardless of final calibration, and as shown in FIGS. 10–12 is angled to intersect Welch plug chamber 208 to thereby provide drill clearance with the mounting boss 220 of the body of carburetor 200. This relationship thus determines how far upstream the Welch plug pocket 208 should extend in the design of the carburetor.

It is also to be understood that the air bleed bypass passageway system of the second embodiment may incorporate more than one outlet passageway 214. For example, two such passageways of equal or differing size may be provided, side-by-side and parallel to one another to provide a variation in the progression of shut off of the outlet portion of the bypass passageway system by movement of control edge 112. Thus it will seen that the second embodiment air bleed bypass system utilizes the air bleed feature and obtains advantages of the first embodiment and also automatically controls this air bleed to improve engine starting and part throttle performance without experiencing the typical detrimental effects of reduced throttle valve opening. It is to be noted that with mini-four-stroke engines with small displacement (i.e., about 26 cc), reducing the throttle opening is often detrimental to starting and idle performance of such engines.

The feature of the second embodiment construction and method of changing the air bleed outlet hole location (and/or sizes and/or number) in relation to the angular position of throttle barrel 22 as a method of enrichening or leaning part throttle fuel flow, i.e., curve C of FIG. 17, provides an economical alternative to changing the throttle cam plate 32 in order to change the control ramp profile for operating the needle valve 38. The ability to modify the curve of FIG. 17 in the part throttle speed range just above idle is important to tune the carburetor to the acceleration needs and performance of any given engine. This feature thus enables a reduction in the number of different cam profile sets of cam plates 32 needed to be kept in inventory from which to select for calibrating carburetors.

Again, it will be understood that factory adjustment of the carburetor to set the maximum idle speed A/F mixture will result in mixture needle 38 being raised farther than it could be without the air bleed passageway system, thereby providing a larger idle orifice in outlet 42 of jet 40 that is less prone to clogging by debris in the fuel being fed to jet 40, and rendering needle 38 less sensitive when adjusting.

Third Embodiment Air Bleed Passageway System

Figure 13:
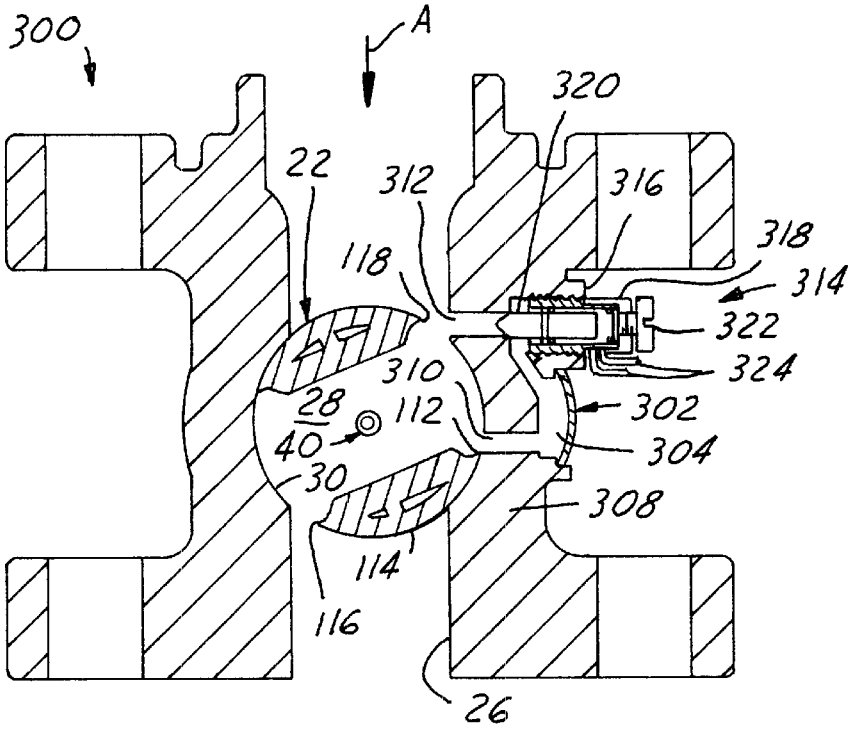
FIGS. 13 and 14 are simplified diagrammatic cross sectional views of a third embodiment air bleed bypass system of the present invention incorporated in a rotary throttle valve carburetor and respectively illustrating a solenoid-operated bypass air regulating valve in a closed, starting condition and in adjusted open, running condition.

FIGS. 13 and 14 show a third embodiment bypass air bleed passageway system of the invention incorporated in a carburetor 300 which may be the same as carburetors 10 or 200 except for the construction of the air bleed bypass passageway system. In this embodiment the bypass passageway system again utilizes a Welch plug 302 to cover a Welch plug pocket 304 provided in a side wall 308 of the carburetor body casting. A bypass outlet passageway 310 is provided in the manner of bypass outlet passageway 214 of the second embodiment and thus extends between chamber 304 and the valve bore 30 in the carburetor body.

However, a bypass inlet passage 312 is provided in the third embodiment which differs from the corresponding bypass inlet passage 212 of the second embodiment. Note that inlet passage 312 extends parallel to bypass outlet passage 310, but again enters bore 26 upstream of throttle valve 22. Thus, bypass passageways 310 and 312 both can be drilled by a drill or drills oriented perpendicular to the axis of bore 26 of the carburetor to thereby facilitate manufacturing operations and set up.

An additional important novel feature of the third embodiment system is the provision of a manually adjustable, solenoid-actuated air bleed regulating valve 314. A mounting boss 316 is provided on the side of the carburetor to provide a threaded bore for receiving an externally threaded casing 318 of valve 314. An armature 320 of solenoid valve 314 is provided in the form of a needle valve, the pointed end of which is designed to enter into and seat against the downstream end of upstream bypass passage 312, as shown in FIG. 13, to thereby close the same in the closed condition of valve 314. In the fully opened condition of valve 314 shown in FIG. 14, the needle tip of armature 320 is fully withdrawn from the downstream outlet of upstream bypass passage 312, but only to the extent allowed by the manual setting of an adjustment set screw 322 of valve 314. Set screw 322 enables screwdriver adjustment of the end limit of the retraction stroke of armature 320. This enables the quantity of bypass air fed via passages 312, chamber 304 and passage 310 in the open condition of valve 314 to be manually adjusted by the operator after the factory setting of mixture needle 38 has been made and permanently set, as described previously hereinabove. Valve 314 has a pair of electrical leads 324 connected to a suitable control circuit (not shown) operable for controllably energizing and de-energizing a solenoid coil within valve 314. Preferably the solenoid spring of valve 314 biases armature 320 to the adjusted open position of FIG. 14, although in some applications the opposite mode of operation can be employed.

Thus, it will be seen that the third embodiment air bleed bypass passageway system of the invention of FIGS. 13 and 14 incorporates features of the first embodiments. Valve 314 provides an external controller for opening and closing the air bleed bypass passage that is an alternative to the valves of FIGS. 5–8. Therefore, the third embodiment system can operate in the manner of the first embodiment system with its attendant advantages in providing a construction and method of enriching the starting mixture in lieu of a choke system without affecting the maximum permitted A/F mixture limit permitted by EPA and/or CARB regulations at engine idling speed.

The third embodiment also can be operated, due to the manual adjustment feature of the de-energized open condition of valve 314, to vary the amount of bypass air and therefore the amount of "leaning out" that can be accomplished by manually adjusting the air screw solenoid valve 314. Hence, the mode of operation set forth in U.S. Pat. No. 5,709,822 relative to the air screw 43 described therein also can be practiced with the third embodiment construction of FIGS. 13 and 14. However, in accordance with a further feature of the present invention embodiment the third embodiment system of FIGS. 13 and 14, instead of closing the bypass air regulating valve when setting the permanent adjustment of the idle needle 38 to obtain maximum permitted richness at engine idle speed in the manner of the '822 patent, the present invention adjusts idle needle 38 to a maximum permissible richness limit at idle engine speed with valve 314 fully open. This means that maximum bypass air is fed into throttle passage 28 while factory adjusting idle needle 38, thereby achieving maximum idle opening of the orifice 42 of jet 40 when making this factory permanent adjustment.

Then when cranking the engine for starting, the automatic control system energizes the solenoid of valve 314 to move needle armature 320 to the closed condition of FIG. 13 so that no bypass air can flow into the throttle valve passage 28. This provides a "choking effect" to facilitate starting of the engine when cranking the same under cold start conditions. As soon as the engine starts and accelerates to idle speed, the bypass solenoid valve 314 is automatically opened by the control system to its adjusted preset open end limit so that the engine A/F mixture at engine idle speed is at but does not exceed the permissible regulated limit of richness for this condition.

Referring again to FIG. 17, it will be seen that the aforementioned condition of enrichment for starting of the engine with the air bleed closed produces the enrichment solid line curve A for the speed range labeled in FIG. 17, which is considerably richer than the broken line curve labeled E, which is that established for the non-enriched starting condition with the air bleed open. The speed range portion indicated B on the curve of FIG. 1 7shows the effect of the air bleed being opened as the engine starts and approaches normal idle speed.

The third embodiment system of FIGS. 13 and 14 also provides the Welch plug and pocket feature of the second embodiment system of FIGS. 9–12 that enables the location of the outlet bypass passage 310 relative to the control edge 112 of valve 22 to be readily varied by design to calibrate the engine and/or modulate or modify the part throttle acceleration curve discussed previously in conjunction with FIG. 17. Note that bypass outlet passage 310 extends perpendicular to the axis of passage 26 so that the ease of manufacturing is enhanced. There also is a range of locations available within the Welch plug pocket 304 for shifting the location of passage 310 in the direction of the axis of passage 26, either upstream or downstream, so this previously described method of enrichening or leaning part throttle operation also can be practiced with the third embodiment system.

It should be understood in conjunction with the third embodiment system, like the first embodiment system of FIGS. 1 through 4, in simplified FIGS. 13 and 14 (and likewise in FIGS. 15 and 16) the plane of the cross section of the bypass passageway system, including valve 314 and boss 316, is offset from the plane of the cross section of mounting bolt holes to an extent sufficient to ensure clearance of the mounting bolt holes relative to the bypass passageway structure.

Fourth Embodiment Air Bleed Passageway System

Figure 15:
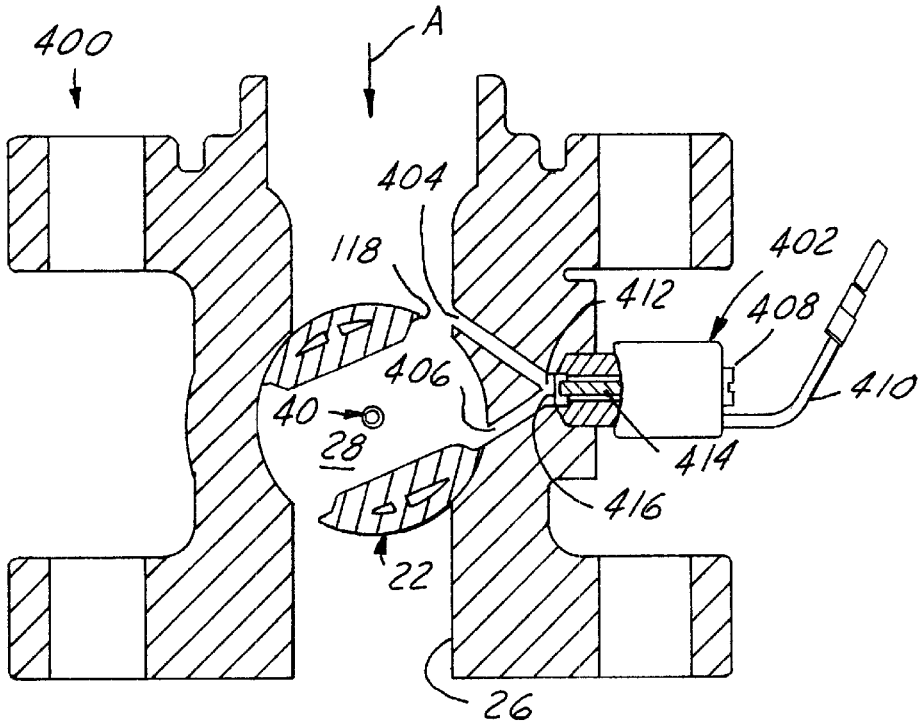
FIGS. 15 and 16 are simplified diagrammatic cross sectional views of a fourth embodiment air bleed bypass system of the present invention incorporated in a rotary valve carburetor with a solenoid-operated bypass air regulating valve shown respectively in adjusted open position (FIG. 15) and in fully closed position (FIG. 16)
Figure 16:
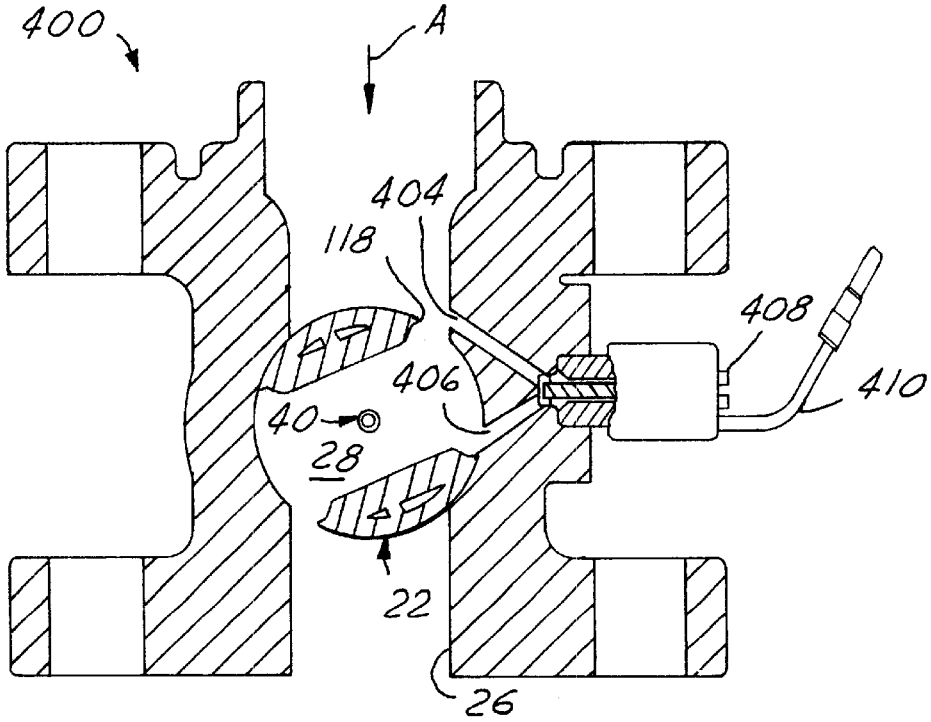

FIGS. 15 and 16 illustrate a fourth embodiment air bleed passageway system, also in accordance with the invention, in which a carburetor 400 of the rotary valve type similar to carburetors 10, 200 and 300 described previously is provided with a multiple function air bleed bypass passageway system that has all the capabilities and modes of operation of the third embodiment system described in conjunction with FIGS. 13 and 14. However, as will be seen in FIGS. 15 and 16, in the fourth embodiment system a different type of solenoid actuated, manually adjustable air screw valve 402 is provided for controlling bypass air flow from an upstream bypass inlet passage 404 to a downstream bypass outlet passage 406. Valve 402, like valve 314 regulates automatically the opened and closed conditions of this system as well as providing manual adjustment of the open end limit setting via a set screw 408 of the valve 402. Again, electrical leads 410 are provided for coupling the solenoid of valve 402 to a suitable control circuit (not shown) operable in the mode described previously. Bypass passageways 404 and 406 are angled relative to one another and to the axis of passage 26, and meet at the vertex seat 412 (FIG. 15) so that drilling angles do not interfere with the mounting lugs of the body of carburetor 400. Valve 402 is the type having an armature 414 carrying a resilient pad 416 on its free end that engages valve seat 412 in the closed condition of the valve shown in FIG. 16. The spacing between seat 412 and pad 416 in the opened condition of the valve is manually adjustable by adjusting set screw 408. Hence when the solenoid is de-energized and the valve spring drives armature 414 to its fully retracted position against the set screw 408, this retraction end limit is set by this stop, and such can be set as desired to define the maximum lean condition of the idle A/F mixture. Preferably the permanent factory adjustment of the idle needle 38 is set with valve 402 fully opened so that when closed at engine cold start condition, maximum enrichment is obtained. Yet the opening of valve 402 when the engine begins to run at idle ensures that the idle A/F does not exceed maximum richness limits set by the applicable air quality regulations.

From the foregoing description it will now be appreciated that the present invention in one or more of the aforementioned preferred but exemplary embodiments readily encompasses one or more of the aforestated objects and provides an improved method of controlling the amount of signal (vacuum) reaching the idle fuel outlet orifice at engine idle speed without significantly reducing the throttle valve opening. The ability of the bypass passageway systems to control this suction pressure at idle also results in a low cost, easy to operate starting system that provides enrichment in lieu of a choke system. Moreover, the aforementioned three-step starting procedure described in conjunction with the first embodiment can be reduced to just two steps by utilizing the solenoid valve 314 or 402 since then it is only required to purge the unit using the purge bulb 202 (FIG. 9) and then pull the starter cord until the engine starts. The air bleed feature also enables the mixture needle to be backed out or up to enlarge the idle orifice opening over that permitted for a non-air bleed carburetor system, and also renders the adjustment of the mixture needle 38 less sensitive than heretofore with a non bleed system. The air screw feature of the third and fourth embodiments enables the operator to manually adjust the lean-out condition of the carburetor to compensate for various ambient conditions such as high altitude, relative humidity etc. Calibration of the carburetor to different engines is rendered more precise and more economical to achieve. The size, location and/or number of bypass outlet passages, as disclosed in conjunction with the second and third embodiments, provides an inexpensive substitute for selecting and switching between a large inventory of cam plates in order to modulate the part throttle acceleration curve of fuel flow versus engine speed (curve "C" versus curve "D" of FIG. 17).

What is claimed is:

1. A method of regulating fuel feed from a carburetor to an associated engine in which the carburetor has a rotary throttle valve with a throttle hole disposed in an air intake passage of the carburetor body, and wherein the quantity of air flow in the air intake passage is controlled by at least rotational movement of the throttle valve to thereby vary the opening area of the throttle hole exposed to the carburetor intake passage for controlling air flow therethrough, the throttle valve being cylindrical and rotatable about an axis transverse to the axes of the throttle hole and carburetor air intake passage, the throttle valve also being axially movable along its rotational axis during such rotational movement and a quantity of fuel is released from a fuel jet port of a fuel supply pipe secured to the carburetor body as controlled by the relative position to such jet port of a fuel regulating needle attached to the throttle valve for axial movement therewith, wherein a closing member is non-removably fitted in said carburetor to permanently prevent exterior access to an adjustment portion of the fuel regulating needle located at one end thereof, and the end of the needle opposite said one end is inserted into said fuel supply pipe so that the adjustment of needle regulation of said fuel jet port cannot be made from outside of said carburetor after an idle speed fuel quantity has been set prior to fitment of said closing member, the carburetor further having a bypass air passage for variably communicating the throttle hole of the throttle valve at an upstream portion thereof with an air source comprising ambient atmosphere or the intake air for the carburetor and in bypass relation to the opening area of the throttle hole exposed to a bypass air passage outlet at engine idle setting of the throttle valve, and wherein a bypass air quantity regulating valve is provided in said bypass air passage to variably adjust the quantity of air flowing in the bypass air passage to the throttle hole, and wherein said bypass air passage outlet is constructed and arranged relative to said throttle valve so as to be closed by movement of said throttle valve out of idle setting toward high speed and/or maximum power setting and thereby de-register the throttle hole with said bypass air passage outlet, said method comprising the steps of:

(a) at initial carburetor-to-engine set-up and calibration, opening the bypass air regulating valve while the engine is running at idle speed to a given open setting of the air flow regulating valve, (b) adjusting the fuel-regulating needle to provide the maximum fuel to air (F/A) mixture ratio permitted by applicable engine exhaust air quality regulations, (c) then permanently setting said fuel needle adjustment by non-removably fitting the closing member to prevent exterior access to an adjustment portion of the fuel needle, (d) then thereafter during subsequent end user operation of the engine closing the bypass air regulating valve only when preparing to crank the engine for starting to thereby provide an enriched fuel-to-air mixture for starting of the engine, and (e) thereafter, upon engine starting and running under its own power, opening the bypass air regulating valve.

2. The method of claim 1 including the further step of:

(f) adjusting the bypass air regulating valve to increase the air flow regulating opening of the same from the given setting to thereby re-adjust the initial set-up F/A mixture to a different and leaner value for end user engine operation.

3. The method of claim 1 comprising the further step of:

(g) providing said bypass air regulating valve in the form of a solenoid-operated valve, and (h) operably coupling the solenoid valve to the engine control system such that the valve automatically is closed for engine start up and opened when the engine begins to run under its own power.

4. The method of claim 3 wherein step (g) further comprises providing said valve with an adjustable end-limit open stop for adjusting the open setting of the bypass solenoid-operated air regulating valve to thereby increase the air flow regulating opening end limit of the same from the given setting to thereby re-adjust the initial set-up F/A mixture to a different and leaner value for engine operation.

5. The method of claim 1 wherein the bypass air passage is provided in the form of a tubular conduit extending through a wall of the carburetor to an external connection with the bypass air regulating valve for communicating the same with the bypass air passage outlet within the carburetor.

6. The method of claim 5 wherein the bypass air regulating valve is provided in the form of a movable flap valve constructed and arranged for controllably opening and closing an open upstream inlet of the tubular conduit.

7. The method of claim 5 wherein the bypass air regulating valve is provided in the form of a solenoid valve having an armature mounted in the tubular conduit with an armature plunger reciprocable therein and having a valve member at its distal end operable for opening and closing a valve port in a valve disk mounted in the tubular conduit.

8. The method of claim 5 wherein the bypass air regulating valve is provided in the form of a normally closed valve that is thermally responsive and operably coupled to the engine to sense engine operational heat of a given temperature to thereby open the bypass valve.

9. The method of claim 3 wherein said bypass passage is provided in the form of a bypass inlet branch passage and a bypass outlet branch passage communicating with the bypass inlet branch passage and terminating at the bypass passage outlet, and wherein the solenoid-operated valve controls flow between the branch passages.

10. The method of claim 9 wherein the branch passages are provided in the form of drilled passages extending between the carburetor exterior surface and the carburetor intake passage, the inlet opening of the inlet branch passage being located upstream of the throttle valve and the outlet of the outlet branch passage being located for communication with the throttle valve throttle hole in the idle position thereof.

11. The method of claim 10 wherein the branch passages are communicated with one another via a Welch plug chamber in the carburetor exterior surface that is closed by a Welch plug.

12. The method of claim 11 wherein the branch passages are drilled parallel to one another and generally perpendicular to the axis of the carburetor air intake passage.

13. The method of claim 12 wherein the solenoid valve is provided with a needle valve armature having a needle nose at its distal end cooperative with a valve seat formed in one of said branch passages.

14. The method of claim 13 wherein the valve seat is at the end of the bypass inlet branch passage entering the Welch plug chamber.

15. The method of claim 9 wherein the outlet of the bypass outlet branch passage is located relative to travel of the upstream control edge of the throttle valve throttle hole so as to modulate the fuel-to-air mixture ratio curve of fuel flow versus engine speed during travel of the control edge past the outlet of the bypass outlet branch passage.

16. The method of claim 9 wherein the bypass branch passages are drilled at opposite acute angles to the carburetor air intake passage axis and intersect one another at a vertex valve seat that opens to a valve mounting hole in the exterior surface of the carburetor body, and the body of the solenoid-operated valve is threadably mounted in the mounting hole and has an armature carrying a valve member cooperable with the vertex valve seat for opening and closing the bypass passage.

17. A method of regulating fuel feed from a carburetor to an associated engine in which the carburetor has a rotary throttle valve with a throttle hole disposed in an air intake passage of the carburetor body, and wherein the quantity of air flow in the air intake passage is controlled by at least rotational movement of the throttle valve to thereby vary the opening area of the throttle hole exposed to the carburetor intake passage for controlling air flow therethrough, the throttle valve being cylindrical and rotatable about an axis transverse to the axes of the throttle hole and carburetor air intake passage, the throttle valve also being axially movable along its rotational axis during such rotational movement and a quantity of fuel is released from a fuel jet port of a fuel supply pipe secured to the carburetor body as controlled by the relative position to such jet port of a fuel regulating needle attached to the throttle valve for axial movement therewith, wherein a closing member is non-removably fitted in said carburetor to permanently prevent exterior access to an adjustment portion of the fuel regulating needle located at one end thereof, and the end of the needle opposite said one end is inserted into said fuel supply pipe so that the adjustment of needle regulation of said fuel jet port cannot be made from outside of said carburetor after an idle speed fuel quantity has been set prior to fitment of said closing member, the carburetor further having a bypass air passage for variably communicating the throttle hole of the throttle valve at an upstream portion thereof with an air source comprising ambient atmosphere or the intake air for the carburetor and in bypass relation to the opening area of the throttle hole exposed to a bypass air passage outlet at engine idle setting of the throttle valve, and wherein said bypass air passage outlet is constructed and arranged relative to said throttle valve so as to be closed by movement of said throttle valve out of idle setting toward high speed and/or maximum power setting and thereby de-register the throttle hole with said bypass air passage outlet, said method comprising the steps of:

(a) at initial carburetor-to-engine set-up and calibration maintaining the bypass air passage open while the engine is running at idle speed, (b) during the conditions of step (a) adjusting the fuel-regulating needle to provide the maximum fuel to air (F/A) mixture ratio permitted by applicable engine exhaust air quality regulations, (c) then permanently setting said fuel needle adjustment by non-removably fitting the closing member to prevent exterior access to an adjustment portion of the fuel needle, (d) then thereafter during subsequent end user operation of the engine closing the bypass air passage only when preparing to crank the engine for starting to thereby provide an enriched fuel-to-air mixture for starting of the engine, and (e) thereafter, upon engine starting and running under its own power, reopening the bypass air passage.

18. The method of claim 17 including the further step of:

(f) providing a bypass air regulating valve for the bypass air passage operable to vary the air flow in the same to thereby re-adjust the initial set-up F/A mixture to a different value by and for end user engine operation.

19. The method of claim 17 comprising the further steps of:

(g) providing a bypass air regulating solenoid valve constructed and arranged for opening and closing the bypass air passage, and (h) operably coupling the solenoid valve to the bypass passage and to the engine control system such that the valve automatically closes the bypass passage for engine start up and opens the bypass passage when the engine begins to run under its own power.

20. The method of claim 19 wherein step (g) further comprises providing said bypass air regulating valve with an adjustable end-limit open stop for adjusting the open setting of the valve to thereby vary an air flow regulating opening end limit of the same to thereby adjust the F/A mixture to a prepared value for engine running operation.

21. The method of claim 17 wherein the bypass air passage is provided in the form of a tubular conduit extending through a wall of the carburetor to an external connection with a source of bypass air for communicating the same with the bypass air passage outlet within the carburetor.

22. The method of claim 21 wherein a bypass air regulating valve is provided in the form of a movable flap valve constructed and arranged for controllably opening and closing an open inlet of the tubular conduit communicating with the source of bypass air.

23. The method of claim 21 wherein the bypass air regulating valve is provided in the form of a solenoid valve.

24. The method of claim 21 wherein the bypass air regulating valve is provided in the form of a normally closed valve that closes the bypass passage and is thermally responsive and operably coupled to the engine to sense engine operational heat of a given temperature to thereby open the bypass valve and thus the bypass passage.

25. A method of regulating fuel feed from a carburetor to an associated engine in which the carburetor has a rotary throttle valve with a throttle hole disposed in an air intake passage of the carburetor body, and wherein the quantity of air flow in the air intake passage is controlled by at least rotational movement of the throttle valve to thereby vary the opening area of the throttle hole exposed to the carburetor intake passage for controlling air flow therethrough, the throttle valve being cylindrical and rotatable about an axis transverse to the axes of the throttle hole and carburetor air intake passage, the throttle valve also being axially movable along its rotational axis during such rotational movement and a quantity of fuel is released form a fuel jet port of a fuel supply pipe secured to the carburetor body as controlled by the relative position to such jet port of a fuel regulating needle attached to the throttle valve for axial movement therewith, wherein a closing member is non-removably fitted in said carburetor to permanently prevent exterior access to an adjustment portion of the fuel regulating needle located at one end thereof, and the end of the needle opposite said one end is inserted into said fuel supply pipe so that the adjustment of needle regulation of said fuel jet port cannot be made from outside of said carburetor after an idle speed fuel quantity has been set prior to fitment of said closing member, the body of the carburetor further having a bypass air passage for variably communicating the throttle hole of the throttle valve at an upstream portion thereof with an air source comprising ambient atmosphere or the intake air for the carburetor and in bypass relation to the opening area of the throttle hole exposed to a bypass air passage outlet at engine idle setting of the throttle valve, and wherein said bypass air passage outlet is constructed and arranged in the carburetor body relative to said throttle valve so as to be closed by movement of said throttle valve out of idle setting toward high speed and/or maximum power setting and thereby de-register the throttle hole with said bypass air passage outlet, said method comprising the steps of:

(a) at initial carburetor-to-engine set-up and calibration maintaining the bypass air passage open while the engine is running at idle speed, (b) during the conditions of step (a) adjusting the fuel-regulating needle to provide the maximum fuel to air (F/A) mixture ratio permitted by applicable engine exhaust air quality regulations, and (c) then permanently setting said fuel needle adjustment by non-removably fitting the closing member to prevent exterior access to an adjustment portion of the fuel needle.

26. The method of claim 25 wherein said bypass air passage is provided in the form of a bypass inlet branch passage and a bypass outlet branch passage that communicates with the bypass inlet branch passage via a Welch plug chamber closed to exterior ambient by a Welch plug, and wherein the bypass outlet branch passage terminates at the bypass passage outlet.

27. The method of claim 26 wherein the bypass air branch passages are provided in the form of drilled passages extending between the Welch plug chamber at the carburetor exterior surface and the carburetor intake passage, the inlet opening of the inlet branch passage being located upstream of the throttle valve and the outlet of the outlet branch passage being located for communication with the throttle valve throttle hole in the idle position thereof.

28. The method of claim 27 wherein the branch passages are drilled parallel to one another and generally perpendicular to the axis of the carburetor air intake passage.

29. The method of claim 26 wherein the outlet of the bypass outlet branch passage is located by calibration relative to travel of the upstream control edge of the throttle valve throttle hole so as to modulate the fuel-to-air mixture ratio curve of fuel flow versus engine speed during travel of the control edge past the outlet of the bypass outlet branch passage.

30. The method of claim 25 wherein the outlet of the bypass air passage is located by calibration relative to travel of the upstream control edge of the throttle valve throttle hole so as to modulate the fuel-to-air mixture ratio curve of fuel flow versus engine speed during travel of the control edge past the outlet of the bypass outlet passage.

31. In a rotary throttle carburetor in which a rotary throttle valve, movable from an idle position to an open throttle position, is positioned in a carburetor body bore oriented transverse to an air hole in said throttle valve having an inlet and an outlet, said carburetor body having a throttle passage registering with said throttle valve air hole and a permanently adjusted fuel regulating needle for varying the jet port of a fuel jet with throttle rotary movement, wherein the improvement comprises a bypass air passage extending through a wall of said carburetor body and having an outlet registering with said throttle passage in the idle position and closed by the rotary throttle when rotated from idle toward wide open throttle (W.O.T.) position, said bypass passage having an upstream end open to a source of bypass air to establish an air bleed at the idle setting of the rotary throttle valve to provide a maximum permissible ratio of fuel to air (F/A) mixture at engine idle speed mode of operation despite the needle being raised to provide a corresponding increased opening in the jet port at the needle idle setting.

32. The carburetor of claim 31 wherein said bypass air passage comprises a tubular conduit extending within said wall of said carburetor to an external connection with a bypass air source for communicating the same with the bypass air passage outlet within the carburetor.

33. The carburetor of claim 31 wherein said bypass air passage comprises inlet and outlet bypass branch passages provided in the form of drilled passages extending between an exterior surface of said carburetor and the carburetor intake passage, an inlet opening of said inlet branch passage being located upstream of said throttle valve and an outlet of said outlet branch passage being located for communication with the throttle valve throttle hole in the idle position thereof.

34. The carburetor of claim 33 wherein said carburetor body has a Welch plug chamber in said exterior surface, a Welch plug closes said chamber from ambient exterior atmosphere, and wherein said bypass branch passages are communicated with one another via the Welch plug chamber.

35. The carburetor of claim 34 wherein said branch passages are drilled parallel to one another and generally perpendicular to the axis of the carburetor air intake passage, and the dimension of said Welch plug chamber parallel to such carburetor air intake passage axis is sufficient to accommodate a plurality of drilling locations for the second outlet bypass branch passage to thereby enable calibration of the F/A mixture by shifting the drilling location of the outlet branch passage relative to travel of an upstream control edge of the throttle valve air hole to thereby modulate the operational curve of fuel flow versus engine speed during rotation of the throttle valve in a part throttle range above idle speed and below W.O.T.

36. The carburetor of claim 35 further including a solenoid valve having a needle valve armature with a needle nose at its distal end and being mounted in said carburetor body such that said needle nose is cooperative with a valve seat formed in one of said branch passages.

37. The carburetor of claim 36 wherein said valve seat is at an end of said bypass inlet branch passage entering the Welch plug chamber.

38. The carburetor of claim 33 wherein said bypass branch passages are oriented at opposite acute angles to the carburetors intake passage axis and intersect one another at a vertex valve seat, said carburetor body having a valve mounting hole in said body exterior surface opening to said vertex valve seat and further including a solenoid-operated valve threadably mounted in the valve mounting hole and having an armature carrying a valve member cooperable with the vertex valve seat for closing the bypass passage for engine cranking at start up and opening the bypass passage when the engine begins running under its own power.

39. The carburetor of claim 38 wherein the outlet of the bypass outlet branch passage is constructed and arranged relative to travel of the upstream control edge of the throttle valve throttle hole so as to modulate the engine operational curve of fuel flow versus engine speed during travel of such upstream control edge past the outlet of the bypass outlet branch passage.

40. In a fuel regulating mechanism for a carburetor in which a throttle valve having a throttle hole is disposed in an air intake passage of a carburetor body, and wherein the quantity of air flow in the air intake passage is controlled by movement of the throttle valve to thereby vary the opening area of the throttle hole exposed to the intake passage upstream of the throttle valve, and a quantity of fuel controlled by a relative position of a fuel regulating needle attached to the throttle valve to a fuel jet port of a fuel supply pipe secured to the carburetor body due to movement of the throttle valve, and wherein the throttle valve is cylindrical and rotatable about an axis transverse to the axes of the throttle hole and carburetor air intake passage and wherein the throttle valve is movable along the axis transverse to the axes of the throttle hole and carburetor air intake passage for controlling air flow through the carburetor air intake passage, and wherein a bypass air passage is provided in the carburetor body variably communicating the throttle hole of the throttle valve at an upstream portion thereof with the intake passage of the carburetor body in bypass relation to the opening area of the throttle hole exposed to the air intake passage at engine idle setting of the throttle, wherein a closing member is non-removably fitted in said carburetor to permanently prevent exterior access to an adjustment portion of the fuel regulating needle located at one end thereof, and the end of the needle opposite said one end is inserted into said fuel supply pipe so that the adjustment of needle regulation of said fuel jet port cannot be made from outside of said carburetor after an idle speed fuel quantity has been set prior to fitment of said closing member and wherein said bypass air passage has an outlet constructed and arranged relative to said throttle valve so as to be closed by movement of said throttle valve out of idle setting toward high speed and/or maximum power setting to thereby de-register the throttle hole with said bypass air passage outlet, the improvement in combination therewith wherein said bypass air passage is constructed and arranged so as to be maintained open when said adjustment of needle regulation is being set and also during engine running at idle speed.

41. The fuel regulating mechanism according to claim 40 wherein said bypass air passage comprises a straight first inlet passage portion and a straight second outlet passage portion in communication with one another, the downstream end of said second portion defining said bypass passage outlet, the upstream end of said first portion defining an inlet of said bypass air passage communicating with the air intake passage of the carburetor body upstream of said valve, and wherein a bypass air quantity regulating valve is threadably mounted in said carburetor body in a threaded opening forming an extension of said first inlet passage portion of said air intake passage.

42. The mechanism of claim 41 wherein said bypass regulating valve has an adjustment head exposed exteriorly of said carburetor body for setting the open stop end limit of opening travel of said valve.

43. The mechanism of claim 42 wherein said bypass regulating valve comprises a solenoid valve operably coupled to the control circuit of an associated engine for closing said valve only when cranking the engine for startup.

* * * * *

UNITED STATES PATENT AND TRADEMARK OFFICE

CERTIFICATE OF CORRECTION

PATENT NO. : 6,585,235 B2
DATED : July 1, 2003
INVENTOR(S) : George M. Pattullo

It is certified that error appears in the above-identified patent and that said Letters Patent is hereby corrected as shown below:

Column 19,
Lines 1-7, delete lines 1 to 7 in its entirety and substitute therefor:
-- (a) at initial carburetor-to-engine set-up and calibration maintaining the by-pass air passage open while the engine is running at idle speed, (b) during the conditions of step (a) adjusting the fuel-regulating needle to provide the maximum fuel to air (F/A) mixture ratio permitted by applicable engine exhaust air quality regulations, --

Column 20,
Line 4, delete "form" and insert -- from --.

Column 21,
Line 18, delete "setting" and insert -- position --.
Line 66, delete "carburetors" and insert -- carburetor --.

Signed and Sealed this

Twenty-eighth Day of October, 2003

JAMES E. ROGAN
*Director of the United States Patent and Trademark Office*